US010038236B2

(12) United States Patent
Kawaguchi et al.

(10) Patent No.: US 10,038,236 B2
(45) Date of Patent: Jul. 31, 2018

(54) ANTENNA APPARATUS PROVIDED WITH RADOME

(71) Applicant: DENSO CORPORATION, Kariya, Aichi-pref. (JP)

(72) Inventors: Kazushi Kawaguchi, Nishio (JP); Kazumasa Sakurai, Nishio (JP); Asahi Kondo, Kariya (JP)

(73) Assignee: DENSO CORPORATION, Kariya, Aichi-pref. (JP)

( * ) Notice: Subject to any disclaimer, the term of this patent is extended or adjusted under 35 U.S.C. 154(b) by 25 days.

(21) Appl. No.: 15/322,850

(22) PCT Filed: Jul. 1, 2015

(86) PCT No.: PCT/JP2015/068956
§ 371 (c)(1),
(2) Date: Dec. 29, 2016

(87) PCT Pub. No.: WO2016/002832
PCT Pub. Date: Jan. 7, 2016

(65) Prior Publication Data

US 2017/0155190 A1 Jun. 1, 2017

(30) Foreign Application Priority Data

Jul. 1, 2014 (JP) ..... 2014-135988

(51) Int. Cl.
*H01Q 1/42* (2006.01)
*H01Q 13/28* (2006.01)
*H01Q 9/04* (2006.01)

(52) U.S. Cl.
CPC ..... *H01Q 1/42* (2013.01); *H01Q 9/0407* (2013.01); *H01Q 9/0485* (2013.01); *H01Q 13/28* (2013.01)

(58) Field of Classification Search
CPC ..... H01Q 13/28; H01Q 1/40; H01Q 1/42; H01Q 9/0407; H01Q 9/0485
See application file for complete search history.

(56) References Cited

U.S. PATENT DOCUMENTS 2,472,089 A * 6/1949 Brennan ..... H01Q 7/00 242/434.7
2,896,010 A * 7/1959 Newman ..... H01Q 1/1214 174/153 A (Continued)

FOREIGN PATENT DOCUMENTS

JP 2006-140956 6/2006

*Primary Examiner* — Tho G Phan
(74) *Attorney, Agent, or Firm* — Knobbe, Martens, Olson & Bear, LLP

(57) ABSTRACT

An antenna apparatus includes: an antenna that performs either transmission or reception of electromagnetic waves having a predetermined frequency; a case provided with a mounting surface on a predetermined surface, mounting the antenna on the mounting surface; a radome formed of a transmissive material allowing the electromagnetic waves to pass therethrough, mounted on the mounting surface so as to cover the antenna. A groove portion is formed on the mounting surface. The radome has a thickness corresponding to a value of ½ wavelength of the electromagnetic waves propagating therethrough multiplied by m, where m is positive integer number. The groove portion is formed in a direction forming a predetermined angle with respect to a normal direction of an opening surface of the antenna, to have a depth defined as ½ wavelength of the electromagnetic waves propagating in the groove portion multiplied by n, where n is positive integer number.

7 Claims, 7 Drawing Sheets

(56) References Cited

U.S. PATENT DOCUMENTS

| | | | | | |
|---|---|---|---|---|---|
| 3,544,848 | A * | 12/1970 | Schaefges | H05K 3/32 | 361/755 |
| 5,648,726 | A * | 7/1997 | Le | G01R 31/021 | 324/555 |
| 7,889,151 | B1 * | 2/2011 | Brock | H01Q 9/27 | 343/700 MS |
| 2014/0292593 | A1 * | 10/2014 | Thiam | H01Q 1/3275 | 343/713 |

* cited by examiner

ANTENNA APPARATUS PROVIDED WITH RADOME

CROSS-REFERENCE TO RELATED APPLICATION

This application is based on and claims the benefit of priority from earlier Japanese Patent Application No. 2014-135988 filed Jul. 1, 2014, the description of which is incorporated herein by reference.

BACKGROUND OF THE INVENTION

Technical Field

The present disclosure relates to an antenna apparatus, and particularly to a technique for suppressing a disturbance of directivity of the antenna apparatus.

Background

Conventionally, antenna apparatus provided with a radome for protecting the antenna body from outside has been known. However, the radome may cause a disturbance of directivity of the antenna apparatus. For example, JP-A-2006-140956 discloses a technique for suppressing a disturbance of the directivity as the antenna apparatus by adjusting thickness of the radome, and a distance between the antenna body and the radome.

CITATION LIST

Patent Literature

[PTL 1]

JP-A-2006-140956

In the above-mentioned apparatus in which the antenna body is supported by an antenna case and the radome is provided in the antenna case so as to cover the antenna body, a groove may be provided in the antenna case, and a rib disposed in the radome engages the groove.

In such an engaging portion, there is a concern that unnecessary waves are generated to cause a disturbance of the directivity of the antenna body.

SUMMARY

Hence it is desired to provide a technique for suppressing a disturbance of the directivity.

One aspect of the present disclosure is an antenna apparatus including an antenna, a case, a radome and a groove portion.

The antenna performs either transmission or reception of electromagnetic waves having a predetermined frequency. The case includes the antenna mounted on a mounting surface which is a predetermined surface. The radome is formed of a transmissive material allowing the electromagnetic waves to pass therethrough, mounted on the mounting surface of the case so as to cover the antenna. The groove portion is formed on the mounting surface of the case.

Specifically, the radome has a thickness corresponding to a value of ½ wavelength of the electromagnetic waves propagating therethrough, multiplied by m, where m is positive integer number. Moreover, the groove portion is formed in a direction forming a predetermined angle with respect to a normal direction of an opening surface of the antenna, to have a depth defined as ½ wavelength of the electromagnetic waves propagating in the groove portion, multiplied by n, where n is positive integer number.

According to such antenna apparatus, since the depth of the groove has a value of n multiplied by ½ wavelength of the electromagnetic waves propagating in the groove portion, a path-length for a round trip of the electromagnetic waves in the groove portion becomes an integral multiple of one wavelength of the electromagnetic waves. In other words, the round trip in the groove portion does not produce any phase difference so that unnecessary waves in the groove portion are suppressed. Therefore, according to the antenna apparatus of the present disclosure, a disturbance of directivity as the antenna apparatus can be suppressed in a state where the radome is provided therein. Effects have been described in the case where electromagnetic waves are transmitted from the antenna via the radome. However, similar effects can be obtained in the case where electromagnetic waves transmitted from outside the antenna apparatus are received via the radome.

It should be noted that the bracketed reference signs in the claims indicate correspondence to specific means in the embodiment as one aspect which will be described later. It is not limited to the technical scope of the present disclosure.

DETAILED DESCRIPTION OF THE PREFERRED EMBODIMENTS

Hereinafter, with reference to the drawings, embodiments to which the present disclosure is applied will be described.

[Configuration]

Figure 1:
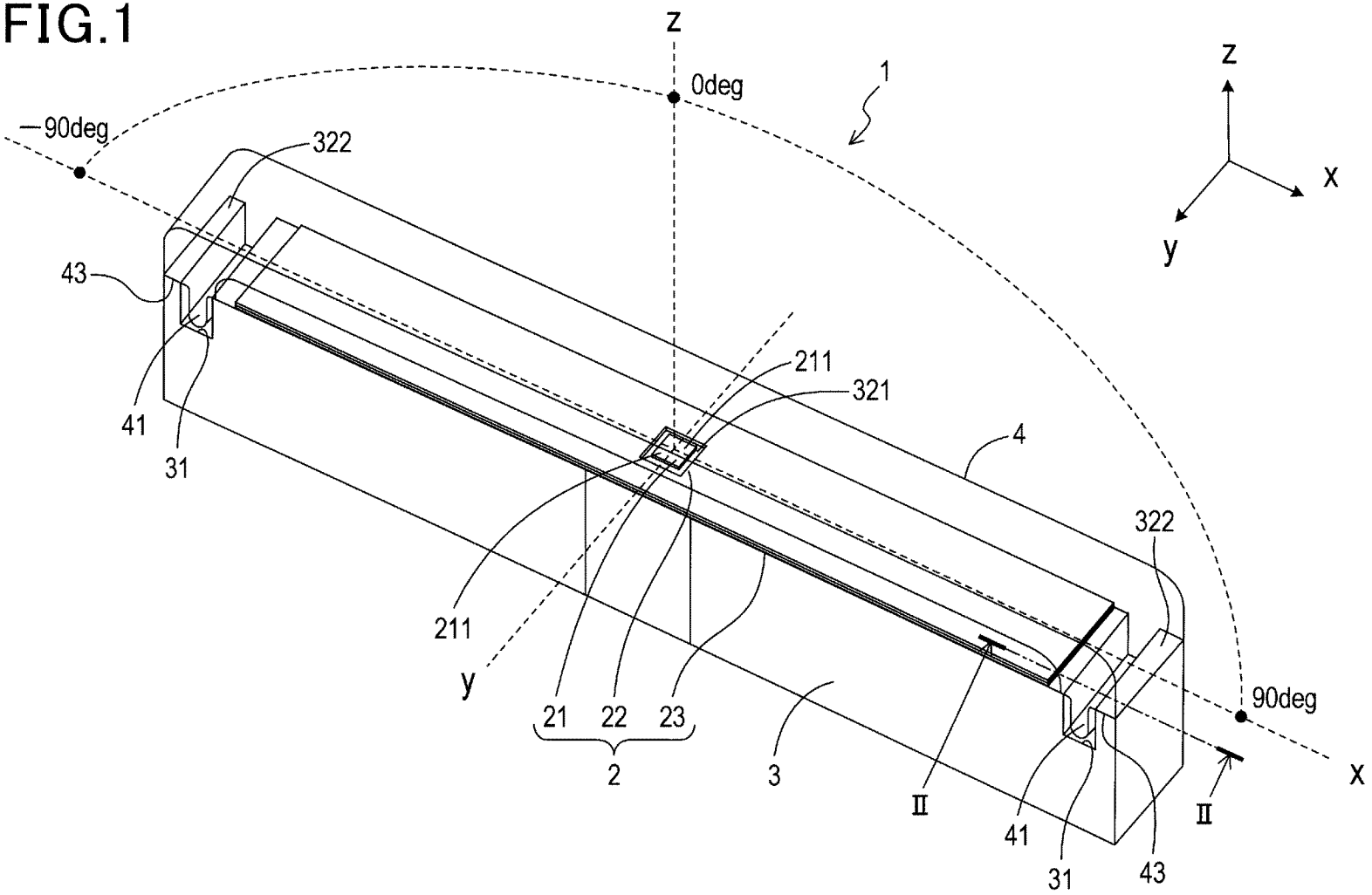
FIG. 1 is a diagram showing an antenna apparatus of an embodiment.

An antenna apparatus 1 according to the present embodiment shown in FIG. 1 is used for, for example, millimeter radar apparatus or the like which monitors around the vehicle. The millimeter radar apparatus transmits electromagnetic waves (hereinafter referred to as radar waves) having a predetermined frequency f0 and receives reflected waves of the radar waves from an object, thereby recognizing the object existing around the vehicle. The antenna apparatus 1 is provided with an antenna portion 2, a case 3 and a radome 4.

The antenna portion 2 is provided with a patch antenna 21, a conductive plate 22 and a dielectric substrate 23. The dielectric substrate 23 has a rectangular shape, in which the patch antenna 21 is formed on one surface of the dielectric substrate 23 and the other surface thereof is mounted on an antenna mounting surface of the case 3. Hereinafter, in the surfaces of the dielectric substrate 23, a surface having the path antenna 21 formed thereon is referred to as an antenna mounting surface.

The patch antenna 21 is provided with a radiation element 211 configured of a conductor formed in a square shape, and a microstripline or the like for the power supply (not shown). Hereinafter, an area where the patch antenna 21 (radiation element 211) is formed is referred to as an antenna opening surface. As shown in FIG. 1, the center portion of the antenna portion 2 (center portion of patch antenna 21) is defined as the origin, the x-axis is defined as an axis passing through the origin and being parallel to the long side of the dielectric substrate 23, the y-axis is defined as an axis passing through the origin and being parallel to the short side of the dielectric substrate 23, and the z-axis is defined as an axis passing through the origin and being perpendicular to a plate surface of the dielectric substrate 23. Hereinafter will be described using the xyz three dimensional coordinate axes.

The microstripline for the power-supply supplies power to the patch antenna 21 (radiation element 211).

The radiation element 211 is arranged such that a pair of mutually faced sides is in parallel to the x-axis direction, and the other pair of mutually faced sides is in parallel to the y-axis direction. The radiation element 211 is formed, for example, with a length of one side of approximately $\lambda p/2$, where $\lambda p$ is wavelength (wavelength in dielectric) corresponding to a predetermined frequency f0 of radar waves, and $\lambda p$ is expressed as $\lambda p=\lambda 0/\sqrt{\in p}$, where the free space wavelength is $\lambda 0$, and relative dielectric constant of the dielectric substrate 23 is $\in p$.

The conductive plate 22 is a plate-shaped conductor formed on the antenna forming surface of the dielectric substrate 23. The conductive plate 22 is formed around the patch antenna 21 (radiation element 211) to be spaced from the patch antenna 21 (radiation element 211).

The patch antenna 21 operates with x-axis direction as a main polarization direction. The patch antenna 21 operate with the xz-surface as a polarization surface (E surface), and configures an antenna capable of favorably transmitting/receiving polarized waves of the xz-surface. Specifically, the directivity of the patch antenna 21 extends in the z-axis direction which is the normal direction of an opening surface of the antenna. As an example, the patch antenna 21 has a symmetric shape with respect to the normal direction.

The radome 4 is formed in an arch shape having a rectangular-shaped roof portion, in which x-direction is longitudinal direction and the y-direction is short side direction. The radome 4 is formed in a shape that covers the antenna portion 2, by attaching the case 3 to the radome 4. The radome 4 is formed of a transmissive material that allows radar waves to pass therethrough with low-loss. The radome 4 is formed such that thickness t of the radome 4 corresponds to a value which of ½ wavelength $\lambda g$ of radar waves propagating through the radome 4, i.e., radar waves propagating through the transmissive material forming the radome 4, multiplied by m, where m is positive integer number. According to the present embodiment, the radome 4 is formed with a value m=1, so as to have the thickness t of $\lambda g/2$ ($t=\lambda g/2$). The wavelength $\lambda g$ of the radar waves passing through the transmissive material is expressed as $\lambda g=\lambda 0/\sqrt{\in p}$, where free space wavelength corresponding to a predetermined frequency f0 of radar waves is $\lambda 0$, and relative dielectric constant of the transmissive material is $\in p$.

A claw portion 41 is formed at a surface 43 extending therefrom, the surface 43 touching the case 3 at both end portions in the longitudinal direction of the radome 4. The claw portion 41 extends from the surface touching the case 3. In the following description, the surface touching the case 3 in the radome 4 is referred to as a radome side contact surface 43. The claw portion 41 is formed extending in the short side direction. In other words, the claw portion 41 is formed in a shape extending in the y-direction perpendicular to the xz-surface which is the polarization surface (E surface) of the patch antenna 21. Further, the claw portion 41 is formed to have a shape capable of being engaged with the groove portion 31 provided in the case 3 which will be described later. As an example, the claw portion 41 is formed such that its length equals to a depth d of the groove portion 31.

The case 3 is formed in a substantially square shape where the longitudinal direction is x-direction and the short side direction is y-direction. The case 3 is formed of a conductor. On the mounting surface 32 which is a prescribed surface of the case 3, an antenna portion 2 and the radome 4 are formed.

In the mounting surface 32 of the case 3, the groove portion 31 is formed on a surface part touching the radome 4 at both ends in the longitudinal direction. Hereinafter, a surface part on which the groove portion 31 is formed in the mounting surface 32 is referred to as a groove forming surface 322. When defining a surface on which the patch antenna 21 is formed in the mounting surface 32 to be an antenna providing surface 321, a clearance between the antenna providing surface 321 and the groove forming surface 322 in the normal direction of the opening surface of the patch antenna 21, i.e., z-direction is a predetermined clearance or less. The predetermined clearance may be the wavelength $\lambda 0$ which is the free space wavelength corresponding to the frequency f0 of radar waves. According to the present embodiment, the antenna apparatus 1 is formed such that the predetermined clearance is 0, that is, the antenna providing surface 321 and the groove forming surface 322 are an identical surface (mounting surface 32).

The groove portion 31 is formed extending in the short side direction of the case 3. In other words, the groove portion 31 is formed on the mounting surface 32 (groove forming surface 322) to have a shape extending in the y-direction perpendicular to xz-surface which is the polarization surface of the patch antenna 21.

The groove portion 31 is formed in a direction forming a predetermined angle with respect to the normal direction (z-direction) of the opening surface of the patch antenna 21, to have a depth of ½ wavelength of radar waves propagating in the groove portion 31, multiplied by n (n is positive integer number). According to the present embodiment, the normal direction of the opening surface of the patch antenna 21 and the normal direction of the mounting surface 32 of the case are the same z-direction, and the groove portion 31 has a shape having a depth in the z-direction.

Figure 2:
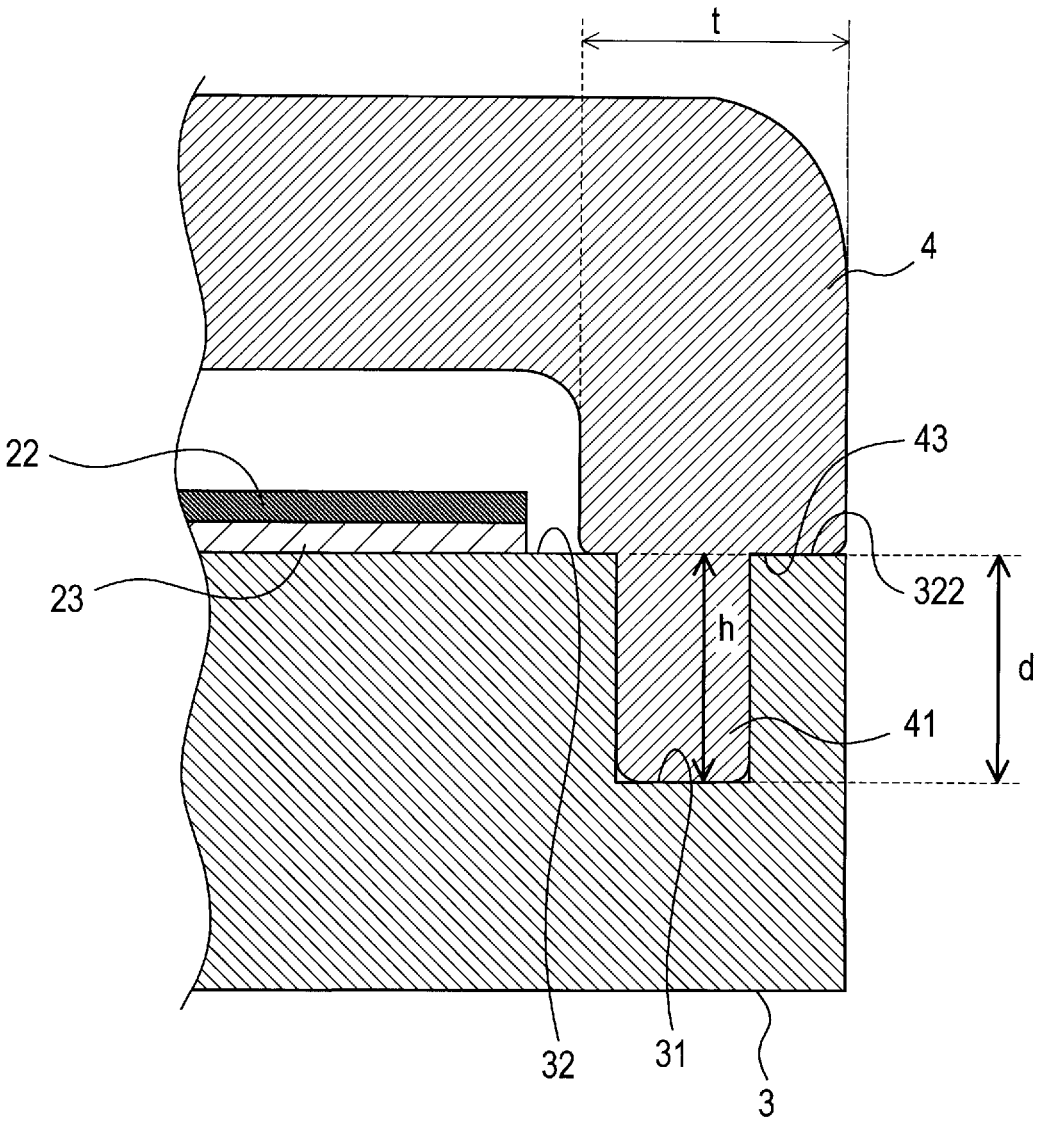
FIG. 2 is a cross-sectional view showing a groove portion and a claw portion.

As shown in FIG. 2, the groove portion 31 is formed to engage the claw portion 41 included in the radome 4 in a state where the radome 4 is mounted on the mounting surface 32 of the case 3. The groove portion 31 is formed to have a value of ½ wavelength $\lambda g$ of the radar waves, multiplied by n (n is positive integer number) in the normal direction (z-direction) of the opening surface of the patch antenna 21, the radar waves propagating through the transmissive material of the claw portion 41 which engages the groove portion 31. According to the present embodiment, the groove portion 31 is formed to have a depth d of $\lambda g/2$ ($d=\lambda g/2$), where n=1.

As described above, the groove portion 31 is formed to engage the claw portion 41 formed in the radome 4. Therefore, the claw portion 41 is formed such that its length h is $\lambda g/2$ ($h=\lambda g/2$).

[Effects]

Effects of the antenna apparatus 1 will be described with an example where radar waves are emitted towards outside the antenna apparatus 1 through the patch antenna 21 and the radome 4.

Figure 3:
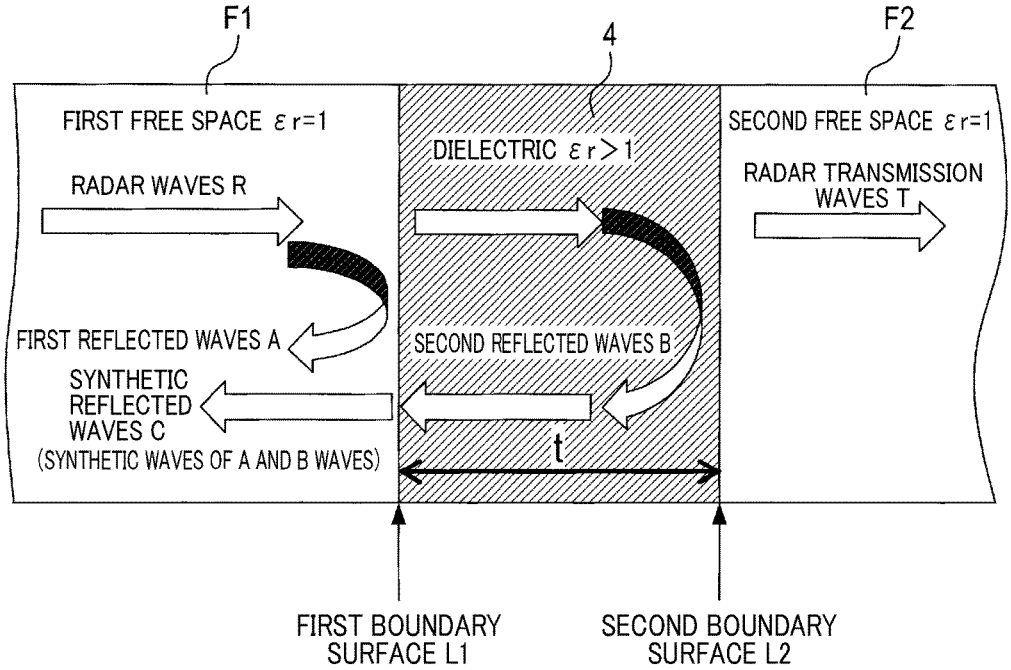
FIG. 3 is a diagram showing radar waves propagating in the groove.

First, effects of the radome 4 will be described. As shown in FIG. 3, the radar waves R emitted from the patch antenna 21 propagates a first free space F1 which is space between the patch antenna 21 and the radome 4.

A part of the radar waves R is reflected at a first boundary surface L1 as a first reflected waves A, the first boundary surface being a boundary surface between the first free space F1 of which the relative dielectric constant $\in r$ is 1 (relative dielectric constant $\in r=1$) and the radome 4 of which the relative dielectric constant $\in r$ is 1 or more (relative dielectric constant $\in r>1$), and the rest of radar waves passes the first boundary surface L1.

The rest of the radar waves R passed through the first boundary surface L1 are reflected at the boundary surface L2 as a second reflective waves B, the second boundary surface L2 being a boundary surface between the radome 4 and a second free space F2 which is outside the antenna apparatus 1, and the rest of the radar waves are emitted to the second free space F2 as radar transmission waves T. The second reflected waves B reflected at the second boundary surface L2 passes through the first boundary surface L1 and enters the first free space F1.

It is known that electromagnetic waves transmitted from a medium having low refractive index to a medium having high refractive index, when being reflected at the boundary surface between the mediums, produce $\pi$ (rad) of phase difference on the reflected waves, and electromagnetic waves transmitted from a medium having high refractive index to a medium having low refractive index produce no phase difference when being reflected at the boundary surface. The refractive index of the medium is a value proportional to the square root of the relative dielectric constant of the medium.

In the first free space F1, the first reflected waves A at the first boundary surface L1 have phase difference of $\pi$ (rad) with respect to the radar waves R. This is because the refractive index of the radome 4 is larger than the refractive index of the first free space F1.

On the other hand, in the first free space F1, the second reflected waves B at the second boundary surface L2 has the same phase as the radar waves R. This is because the refractive index of the radome 4 is smaller than the refractive index of the free space F2, so that a phase difference is not produced when being reflected. Also, a path-length for a round trip in the radome 4 having a thickness t corresponding to $\lambda g/2$ becomes 1 wavelength ($\lambda g$), so that no phase difference is produced with respect to the radar waves R when making the round trip in the radome 4.

Accordingly, since the first reflected waves A and the second reflected waves B has a phase difference $\pi$ (rad) therebetween, i.e., reverse phase, these phases cancel with each other. In other words, synthetic reflected waves C in the first free space F1 are suppressed, or attenuation of the radar transmission waves T emitted to the second free space F2 is suppressed. Thus, disturbance of the directivity of the antenna apparatus 1 is suppressed.

Figure 4:
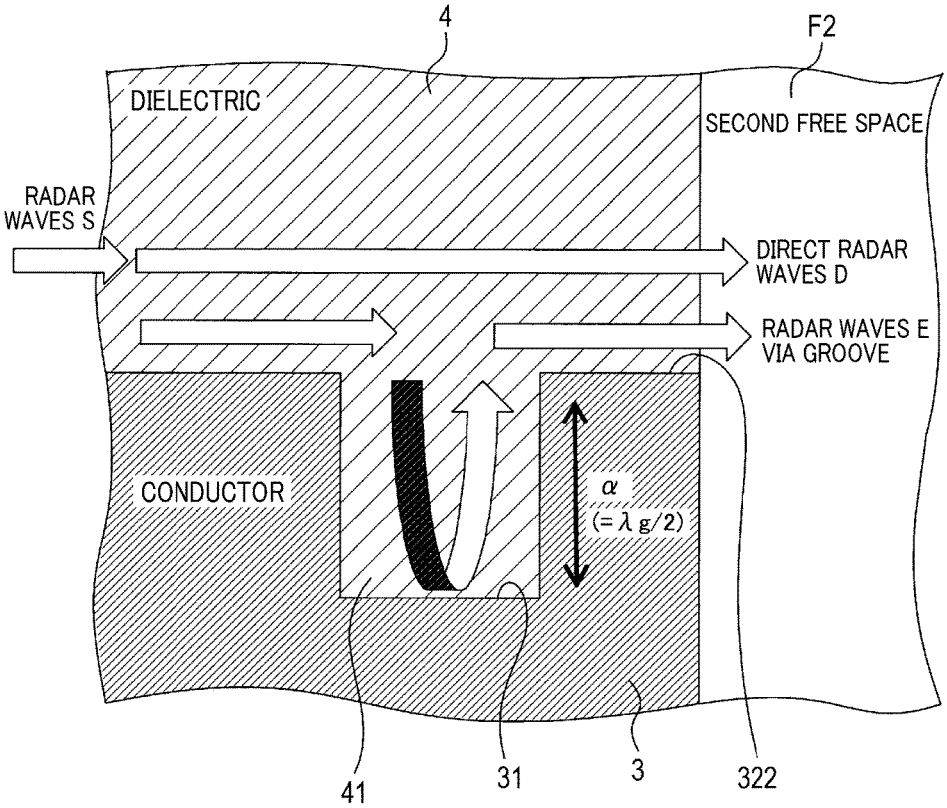
FIG. 4 is a diagram showing radar waves propagating in the groove portion.

Next, effects of the groove portion 31 formed in the case 2 will be described. As shown in FIG. 4, in the case where radar waves S propagating through the radome 4 pass through the second boundary surface L2 and are emitted to the second free space F2, the radar waves emitted to the second free space F2 is defined as synthetic waves of direct radar waves D directly propagating the radome 4 and radar waves E propagated via the claw portion 41 which is engaged with the groove portion 31.

The phase of the radar waves E passing though the claw portion 41 are the same phase as the direct radar waves D. This is because, the path-length corresponds to one wavelength ($\lambda g$) in a state where the radar waves E make roundtrip via the claw portion 41 engaged with the groove portion 31 of which the depth is $\lambda g/2$, so that a phase difference is not produced with respect to the direct radar waves D. Thus, occurrence of unnecessary waves is suppressed at the claw portion 41 (groove portion 31), thereby preventing the direct radar waves D from being attenuated. As a result, a disturbance of the directivity of the antenna apparatus 1 can be minimized.

[Effects]

According to the above-described embodiments, the following effects can be obtained.

[3A] The radome 4 is formed to have a thickness t suppressing attenuation of the radar waves propagating the radome 4, and mounted to the case 3 by engaging the claw portion 41 with the groove portion 31. The case 3 is formed to have a depth d such that phase difference due to round trip through the groove portion 31 is not produced, thereby suppressing unnecessary waves produced in the groove portion 31. Hence, a disturbance of the directivity as the antenna apparatus 1 can be suppressed in a state where the antenna apparatus 1 has a radome 4.

Figure 5:
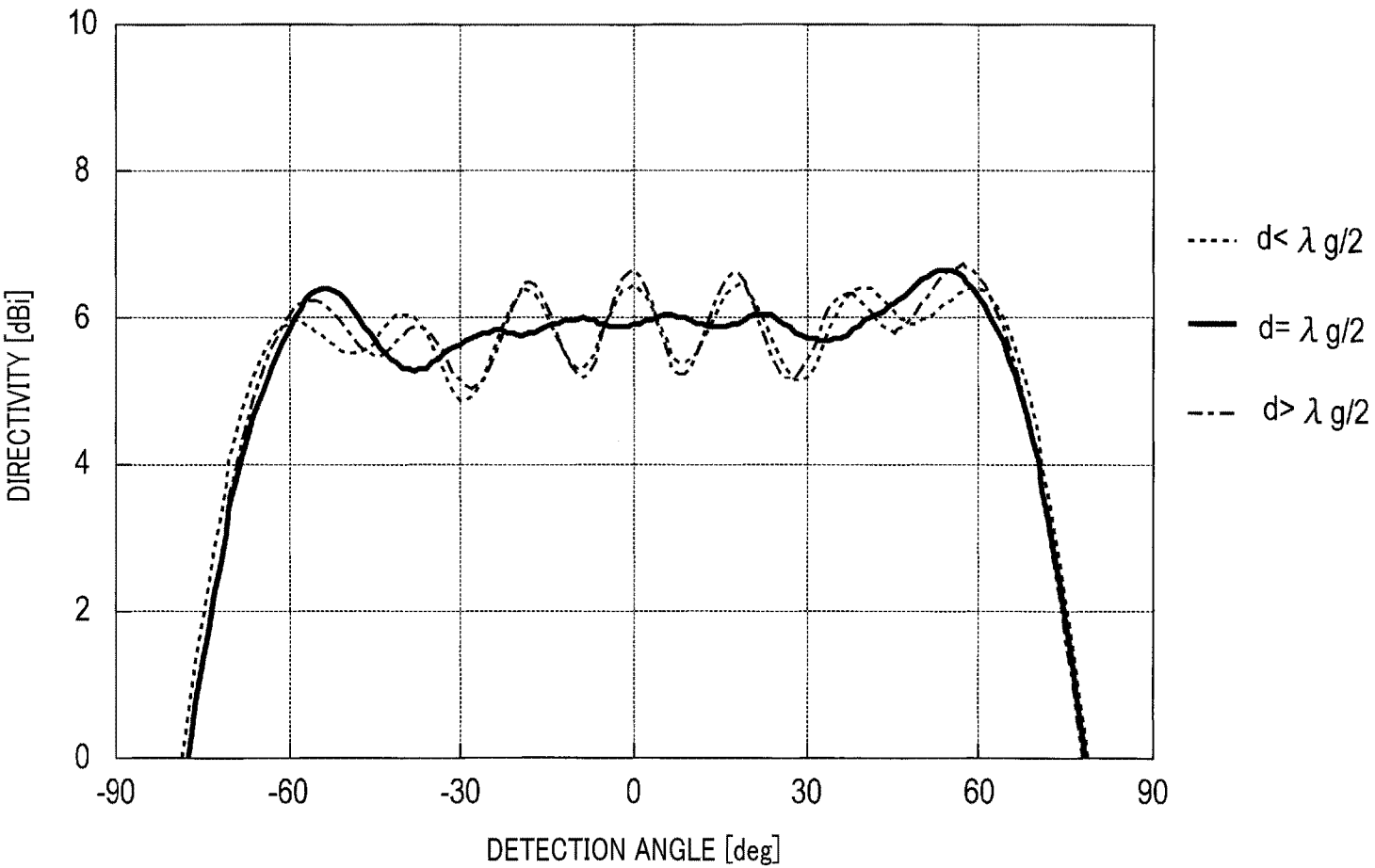
FIG. 5 is a diagram showing an example of directivity of the antenna apparatus according to the embodiment.

FIG. 5 is a diagram showing an example of the directivity of the antenna apparatus 1. In the case where the depth d of the groove portion 31 is set corresponding to ½ wavelength of the radar waves propagating through the groove portion 31, the directivity is approximately constant in a wider detection angle range, compared to other cases. In other words, only a small disturbance is confirmed on the directivity.

Figure 6:
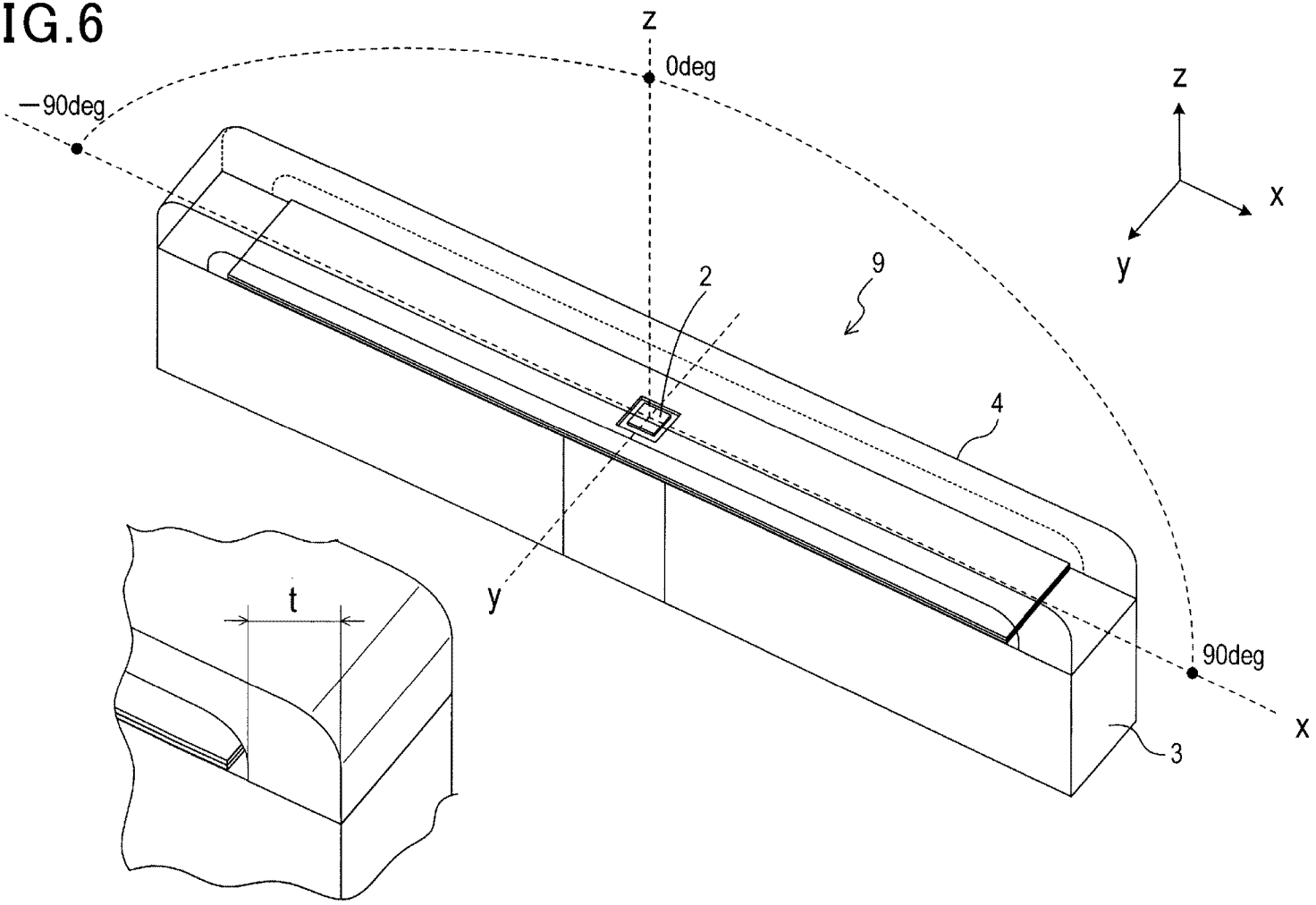
FIG. 6 is a diagram showing an antenna apparatus of a comparative example.
Figure 7:
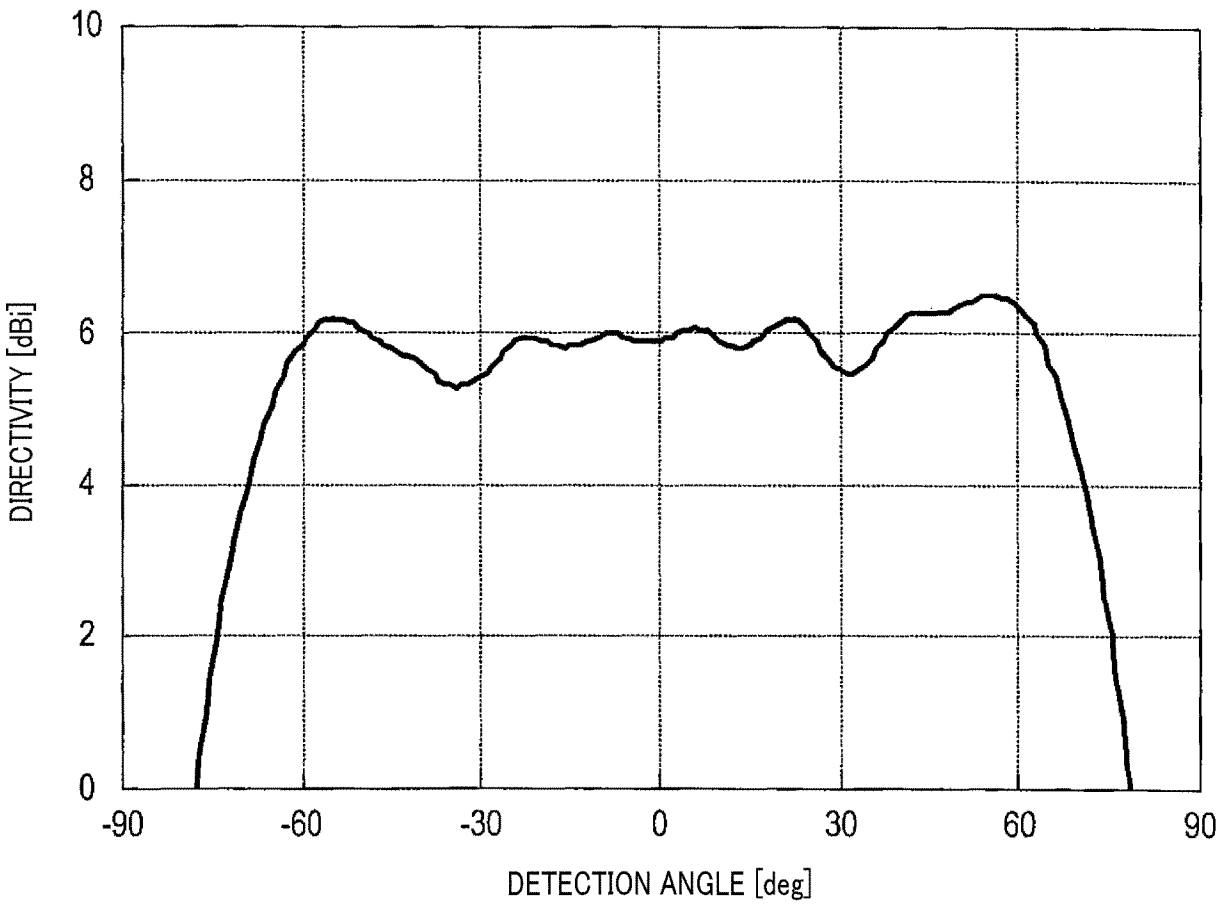
FIG. 7 is a graph showing an example of directivity of the antenna apparatus according to the comparative example.

As a comparative example, FIG. 7 illustrates an example of directivity of an antenna apparatus 9 shown in FIG. 6. The antenna apparatus 9 of the comparative example has a configuration excluding the groove 31 of the present embodiment in the case 3 (configuration excluding the claw portion 41), having the thickness t of the radome 4 which corresponds to $\lambda g/2$ similar to the present embodiment. It is confirmed that the antenna apparatus 9 has constant directivity in a wide detection angle range (small disturbance in directivity).

As shown in FIGS. 5 and 7, apparently, in the case where the groove portion 31 is provided in the case 3 in order to attach the radome 4 to the case 3, unnecessary waves are produced in the groove portion 31, thereby causing a disturbance of the directivity of the antenna apparatus.

According to the antenna apparatus 1 of the present embodiment, since both of the thickness t of the radome 4 and the depth d of the groove portion 31 correspond to ½ wavelength of the radar waves propagating therethrough ($\lambda g/2$), unnecessary waves can be suppressed so that a disturbance of the directivity of the antenna apparatus 1 can be suppressed.

According to the present embodiment, a case has been described in which radar waves are emitted from the patch antenna 21 via the radome 4. However, similar effects can be obtained, when radar waves are received from outside the antenna apparatus 1 via the radome 4.

[3B] The groove 31 is formed extending in a direction perpendicular to a polarization surface (xz surface) which is a predetermined surface including a normal direction (z-direction) of the opening surface of the patch antenna 21.

Thus, for electromagnetic waves (E-waves) at the polarization surface, occurrence of unnecessary waves at the groove portion 31 can be effectively suppressed. In particular, a disturbance of the directivity in a large detection angle range can be suppressed.

[3C] The radome 4 is provided with the claw portion 41 which is a convex portion engaging with the groove portion 31 provided in the case 3. Thus, the radome 4 can be stably fixed to the case 3.

[3D] The antenna providing surface 321 and the groove forming surface 322 are configured to be the same surface (mounting surface 32). Thus, especially in a large detection angle range, a disturbance of the directivity of the patch antenna 21 can be suppressed.

It should be noted that the antenna portion 2 and the patch antenna 21 correspond to an example of an antenna, and the claw portion 41 corresponds to an example of the convex portion.

OTHER EMBODIMENT

Embodiments of the present disclosure have been described so far. However, the present disclosure is not limited to the above-described embodiments, and apparently, the present embodiments can be modified in various ways.

[4A] According to the above-described embodiments, the groove portion 31 of the case 3 is formed extending in the short side direction (y-direction) of the case 3. However, it is not limited thereto. For example, a plurality of groove portions 31 may be formed in the short side directions with prescribed intervals. Also, a direction along which the groove portion 31 is formed to extend, and a direction along which the grove portions 31 are arranged with prescribed intervals are not limited to the short side direction, but any directions can be used. However, as disclosed in the foregoing embodiments, the short side direction of the case 3, i.e., a direction perpendicular to the polarization surface (xz-surface) is preferably used.

[4B] According to the above-described embodiments, the claw portion 41 is formed on the radome 4 to engage the groove portion 31, but this is not limited thereto. For example, the claw portion 41 is not necessary formed in the radome 4. In this case, it is considered that adhesive material or the like is filled into the groove portion 31 and the radome 4 is fixed to the case 3. In this case, the depth d of the groove portion 31 may correspond to a wavelength where ½ wavelength of the radar waves is multiplied by n, the radar waves propagating an adhesive instead of the transmissive material forming the claw portion 41.

[4C] According to the above-described embodiments, the radiation element 211 having a square shape in the patch antenna 21 is formed such that length of one side is approximately $\lambda p/2$, but it is not limited thereto. Since the length $\lambda p/2$ is one example, appropriate length may be set depending on various conditions such as a shape, a size of the case 3.

[4D] According to the above-described embodiment, the patch antenna 21 serves as a transmission/reception antenna. However, it is not limited thereto. The patch antenna 21 may serve as a transmission antenna or may serve as a reception antenna.

[4E] A plurality of functions included in a single element of the above-described embodiments may be distributed a plurality of elements, or functions included in a plurality of elements may be integrated to one element. A part of configurations of the above-described embodiments can be replaced by known configuration. Also, a part of configurations of the above-described embodiments can be omitted as long as problems can be solved. At least part of the above-described configuration may be added to other configuration of the above-described embodiments, or may replace other configuration of the above-described embodiments. It should be noted that various aspects inherent in the technical ideas identified by the scope of claims are defined as embodiments of the present disclosure.

REFERENCE SIGNS LIST

1: antenna apparatus
2: antenna portion
3: case
4: radome
21: patch antenna
31: groove portion
32: mounting surface
321: antenna providing surface
322: groove forming surface 322
41: claw portion
43: radome side contact surface

The invention claimed is:

1. An antenna apparatus comprising:

an antenna that performs either transmission or reception of electromagnetic waves having a predetermined frequency;

a case provided with a mounting surface on a predetermined surface, mounting the antenna on the mounting surface;

a radome formed of a transmissive material allowing the electromagnetic waves to pass therethrough, mounted on the mounting surface so as to cover the antenna; and a groove portion formed on the mounting surface, wherein the radome has a thickness corresponding to a value of ½ wavelength of the electromagnetic waves propagating therethrough multiplied by m, where m is positive integer number;

the groove portion is formed in a direction forming a predetermined angle with respect to a normal direction of an opening surface of the antenna, to have a depth defined as ½ wavelength of the electromagnetic waves propagating in the groove portion multiplied by n, where n is positive integer number.

2. The antenna apparatus according to claim 1, wherein the groove portion is formed extending in a direction perpendicular to a polarization surface which is a predetermined surface including the normal direction of the opening surface of the antenna.

3. The antenna apparatus according to claim 2, wherein the radome has a convex portion engaging the groove portion.

4. The antenna apparatus according to claim 2, wherein the mounting surface has an antenna providing surface on which the antenna is provided, and a groove forming surface on which the groove is formed; and a clearance is provided between the antenna providing surface and the groove forming surface in the normal direction of the opening surface of the antenna, the clearance being a predetermined clearance or less.

5. The antenna apparatus according to claim 1, wherein the radome has a convex portion engaging the groove portion.

6. The antenna apparatus according to claim 1, wherein the mounting surface has an antenna providing surface on which the antenna is provided, and a groove forming surface on which the groove is formed; and a clearance is provided between the antenna providing surface and the groove forming surface in the normal direction of the opening surface of the antenna, the clearance being a predetermined clearance or less.

7. The antenna apparatus according to claim 1, wherein the mounting surface has an antenna providing surface on which the antenna is provided, and a groove forming surface on which the groove is formed; and a clearance is provided between the antenna providing surface and the groove forming surface in the normal direction of the opening surface of the antenna, the clearance being a predetermined clearance or less.

* * * * *